US005778628A

United States Patent [19]

Pendley

[11] Patent Number: 5,778,628

[45] Date of Patent: Jul. 14, 1998

[54] ROOF NETTING CARRIER SLED

[75] Inventor: Timothy M. Pendley, Visalia, Calif.

[73] Assignee: Golden Eagle Building Products, Inc., Madera, Calif.

[21] Appl. No.: 792,900

[22] Filed: Jan. 31, 1997

[51] Int. Cl.[6] ..... E04D 15/06

[52] U.S. Cl. ..... 52/749.12; 52/745.02; 52/745.13; 52/749.15

[58] Field of Search ..... 52/749.12, 749.15, 52/745.02, 745.13, 404.3, 404.5, 407.4

[56] References Cited

U.S. PATENT DOCUMENTS

| | | | |
|---|---|---|---|
| 3,992,847 | 11/1976 | Heath | 52/749.12 X |
| 4,222,212 | 9/1980 | Alderman | 52/749.12 |
| 5,251,415 | 10/1993 | Van Auken et al. . | |
| 5,381,597 | 1/1995 | Petrove | 52/749.12 X |
| 5,406,764 | 4/1995 | Van Auken et al. . | |
| 5,551,203 | 9/1996 | Aldreman et al. | 52/749.12 X |

*Primary Examiner*—Christopher Kent
*Attorney, Agent, or Firm*—Mark D. Miller

[57] ABSTRACT

A uniquely designed sled and a method for its use in distributing roof netting on a building during construction and prior to installation of the roof itself. The sled is brought to the roof level so that it straddles the secondary roof members of the building under construction, and is then loaded with a roll of roof netting. A rope attached to the front of the sled allows it to be pulled across (perpendicular to) the roof support members as the netting is unrolled and deployed through a distribution box. The rails of the sled are long enough to stretch across at least two (2) secondary roof members at a time in order to prevent the sled from falling through as it slides across them. A specially designed mounting platform and distribution box with a top door are provided in the sled to efficiently dispense the netting onto and over the secondary roof members. The outside edges of the netting are attached to the sides of the building, and the inside edges are attached to each other to create a single large net covering the entire roof area.

5 Claims, 6 Drawing Sheets

ROOF NETTING CARRIER SLED

BACKGROUND OF THE INVENTION

1. Field of the Invention

The present invention relates to the installation of roofing, and more particularly to a new sled for use in distributing roof netting over the beams and purlins of buildings especially metal buildings.

2. Description of the Prior Art

Roof netting has been installed in buildings, especially metal buildings, to support insulation in the roof. Recently, roof netting systems have sought the added benefit of providing a measure of safety to workers performing the roofing and insulation installation during construction. However, installation of netting in roof systems on buildings has heretofore been accomplished using cumbersome and difficult methods. The following U.S. Patents are known to exist:

| U.S. Pat. No. | Inventor. | Issue Date |
|---|---|---|
| 5,251,415 | Van Auken, et al | Oct. 12, 1993 |
| 5,406,764 | Van Auken, et al | April 18, 1995 |

The '415 patent to Van Auken describes a method of installing roof netting which draws the netting from a roll at ground level onto and across the roof. Other methods of installing roof netting involve providing support for such netting from below on vertical poles. Each of these methods is slow, cumbersome, labor intensive, and exposes workers to a significant level of risk during the netting installation process.

SUMMARY OF THE INVENTION

The present invention provides a new, easy and efficient method and apparatus for dispensing roof netting that minimizes the exposure of workers to risk from falls. The apparatus of the present invention is a uniquely designed sled upon which one or more rolls of roof netting is placed. The sled is attached to a rope or other motion inducing means, and is designed to slide across the roof purlins perpendicular thereto. The rails of the sled are long enough to stretch across at least two (2) secondary roof members in order to prevent the sled from falling through as it slides across the secondary roof members. A specially designed mounting platform and distribution box with trap door are provided in the sled to efficiently and evenly dispense the netting onto and over the secondary roof members of the building.

In operation, a rope or other deployment means is attached to the forward end of the sled. The sled is then loaded with at least one roll of netting. This may be accomplished either on the ground whereupon the loaded sled is hoisted up to the roof, or at the edge the roof itself. Once loaded, the rope is used to slowly pull the sled either manually or mechanically across the secondary roof members. As the sled moves across the roof members, the roll of netting is unrolled and passed through the distribution box (cone) which acts as a guide through which the netting is dispensed across the roof members and purlins. The entire roll of netting is passed through the distribution box and spread across the width of the building until it is used up. Roll after roll of netting is loaded onto the sled and spread across the building in this way. These large pieces of spread-out netting are attached to each other using nylon lashings or ties at appropriate intervals, usually about six-inches (6") apart. It is preferable that the large netting pieces be attached to each other along a secondary roof member, purlin or beam instead of in the open spaces between such supports.

The outside edges of the netting which reach the walls of the building are attached to clips, hooks, or other fasteners which have been permanently mounted to the building walls. These clips may also be used, if desired, to more securely attach the netting to the tops or sides of the secondary roof members, purlins or beams. The spacing between clips should be at appropriate intervals to provide the necessary support, usually the same as between netting pieces (i.e. 6").

It is therefore a primary object of the present invention to provide a easy and efficient method and apparatus for dispensing roof netting over the secondary roof members of metal buildings during construction.

It is also an important object of the invention to provide a method and apparatus for dispensing roof netting over the secondary roof members of metal buildings during construction that improves safety by exposing the users thereof to a reduced level of risk from falls.

It is also an important object of the invention to provide a method and apparatus for evenly distributing roof netting over the secondary roof members of metal buildings during construction to facilitate easy final attachment of the netting to the building.

It is also an important object of the invention to provide a method and apparatus for securely attaching roof netting to the edges and/or secondary roof members of a metal building during construction.

Other objects of the invention will be apparent from the detailed descriptions and the claims herein.

DETAILED DESCRIPTION OF THE DRAWINGS

Figure 1:
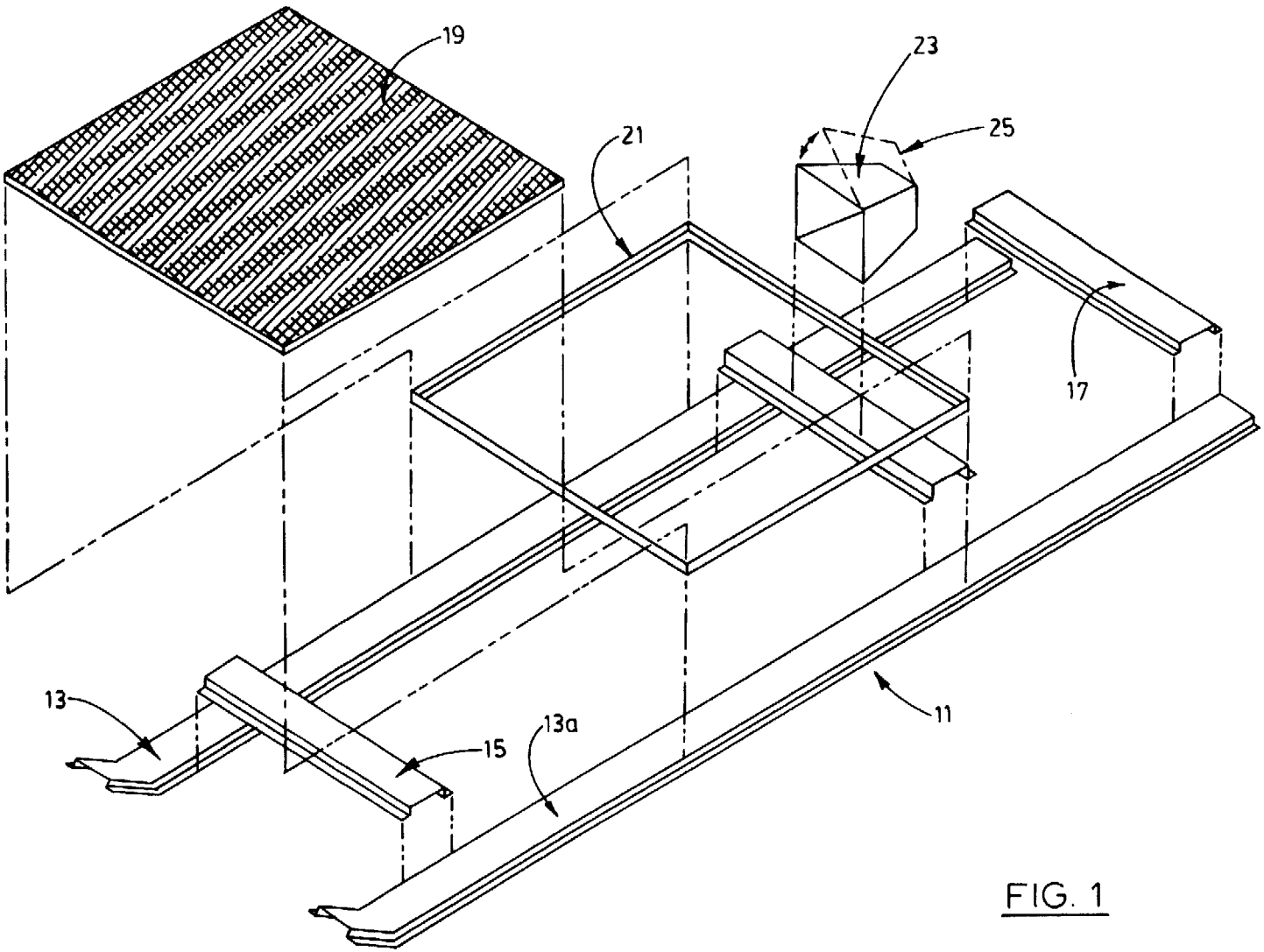
FIG. 1 is a perspective and partially exploded view of the sled of the present invention.
Figure 2:
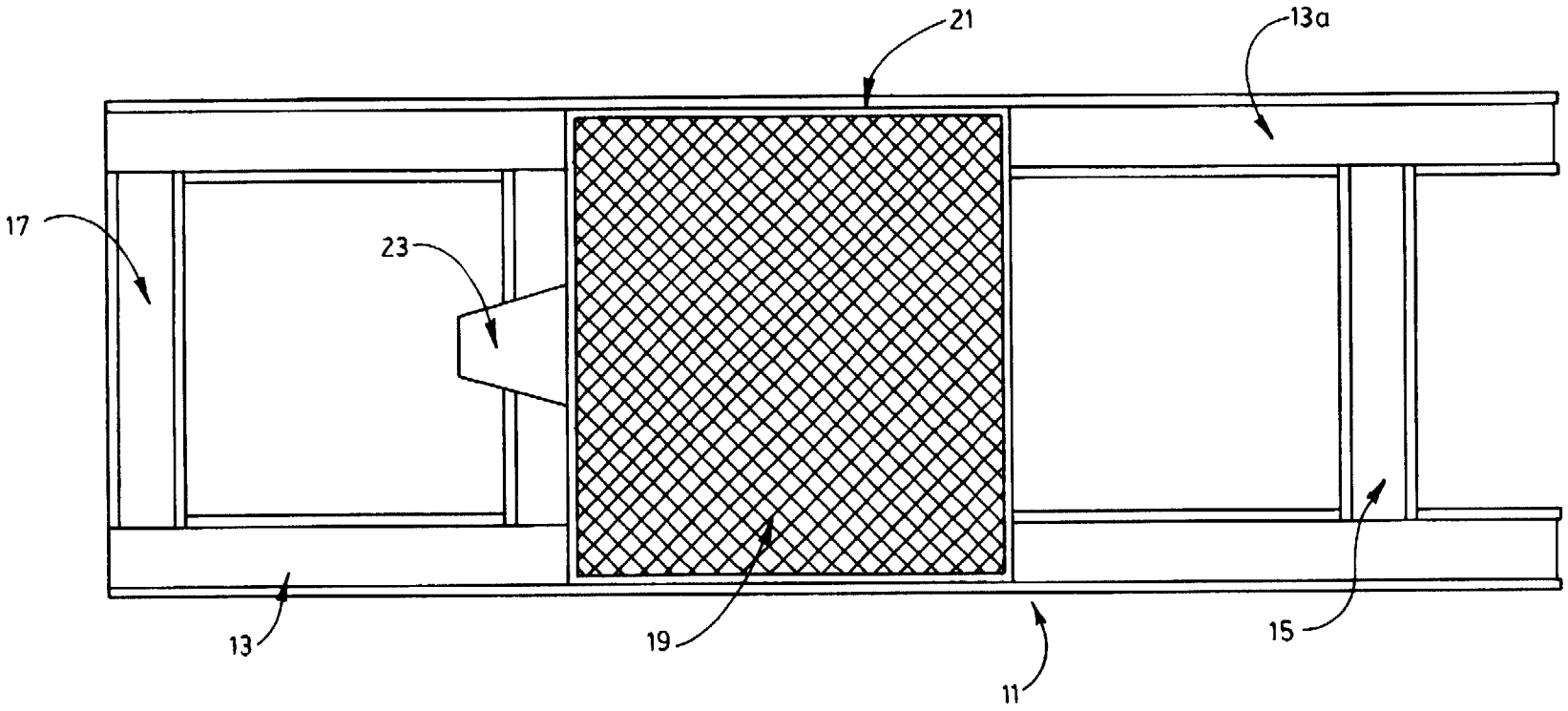
FIG. 2 is a top plan view of the sled of the present invention.
Figure 3:
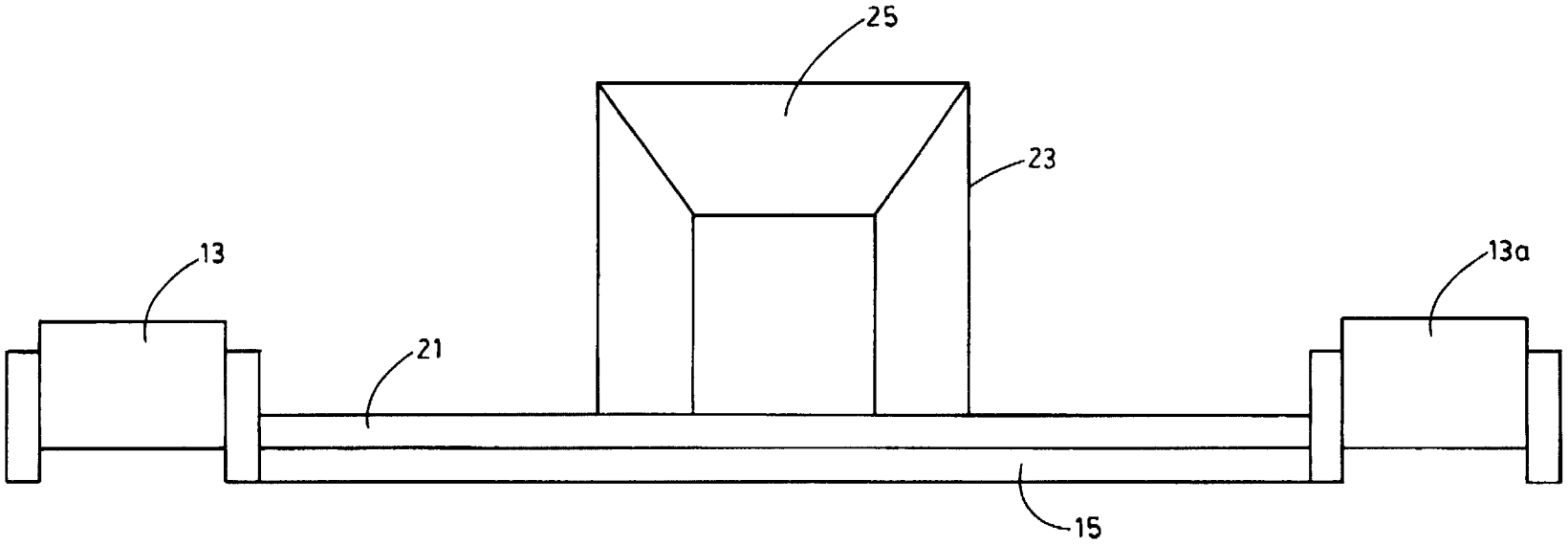
FIG. 3 is a front end view of the sled of the present invention.
Figure 4:
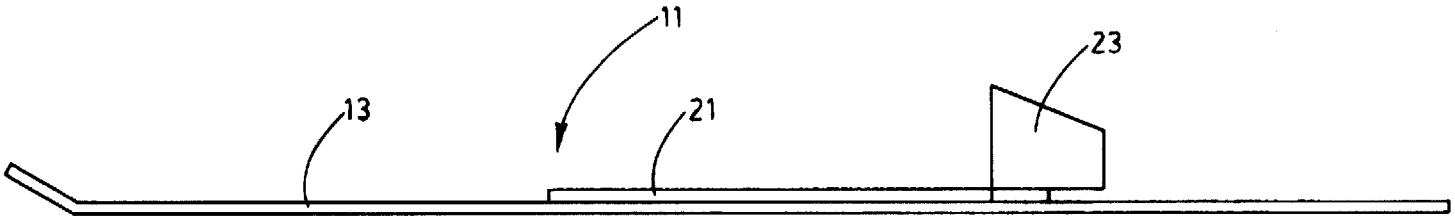
FIG. 4 is a side view of the sled of the present invention.
Figure 5:
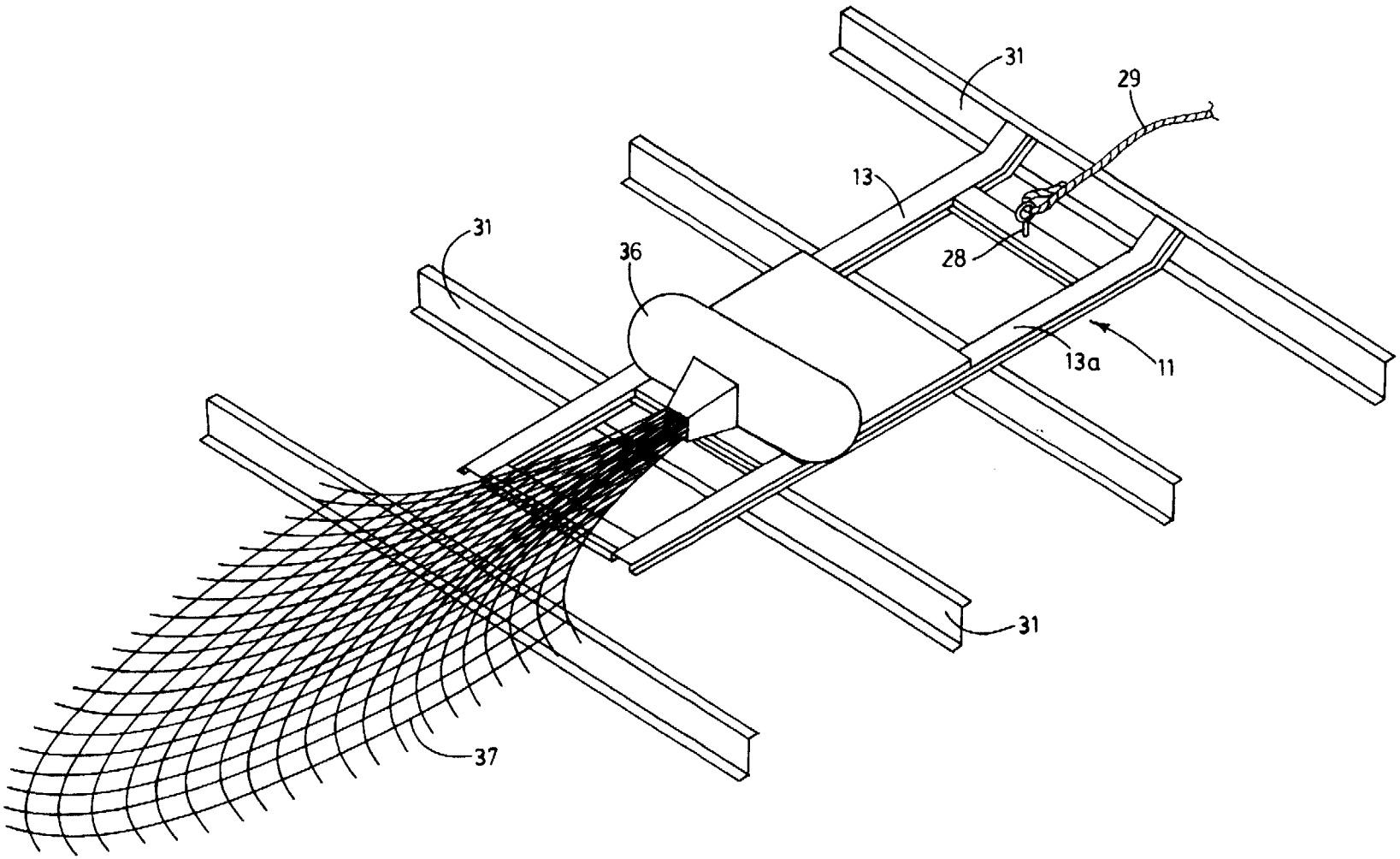
FIG. 5 is an environmental view showing the sled carrying roof netting during installation.

Referring to the drawings wherein like reference characters designate like or corresponding parts throughout the several views, and referring particularly to FIGS. 1 and 5 it is seen that the invention includes a sled, generally 11, having a pair of parallel rails 13 and **13*a* separated by a front support member 15 and a rear support member 17. The front tips of rails 13 and 13*a* are bent upward in order to prevent the sled from being stopped by the roof support members 31 as it slides across them. A hitch 28 is provided on member 15 to which a rope or other motion imparting means 29 may be attached. A platform or deck 19 is provided near the middle of the sled, supported by frame 21. An open-ended, tapered distribution box or cone 23 is provided aft (toward the rear) of platform 19. Box 23 is open at both ends, and is tapered from front to rear thereby providing a larger opening at the front for receiving a roll of netting 36, and a smaller opening at the rear for dispensing the netting as shown in FIG. 5. A door or opening 25 is provided at the top of distribution box 23 to aid in receiving or removing a roll of netting 36 (see FIG. 1). This door is particularly useful for allowing a partially distributed roll of netting 36** to be removed from the sled so that the sled can be used at a different location with another roll.

Figure 6:
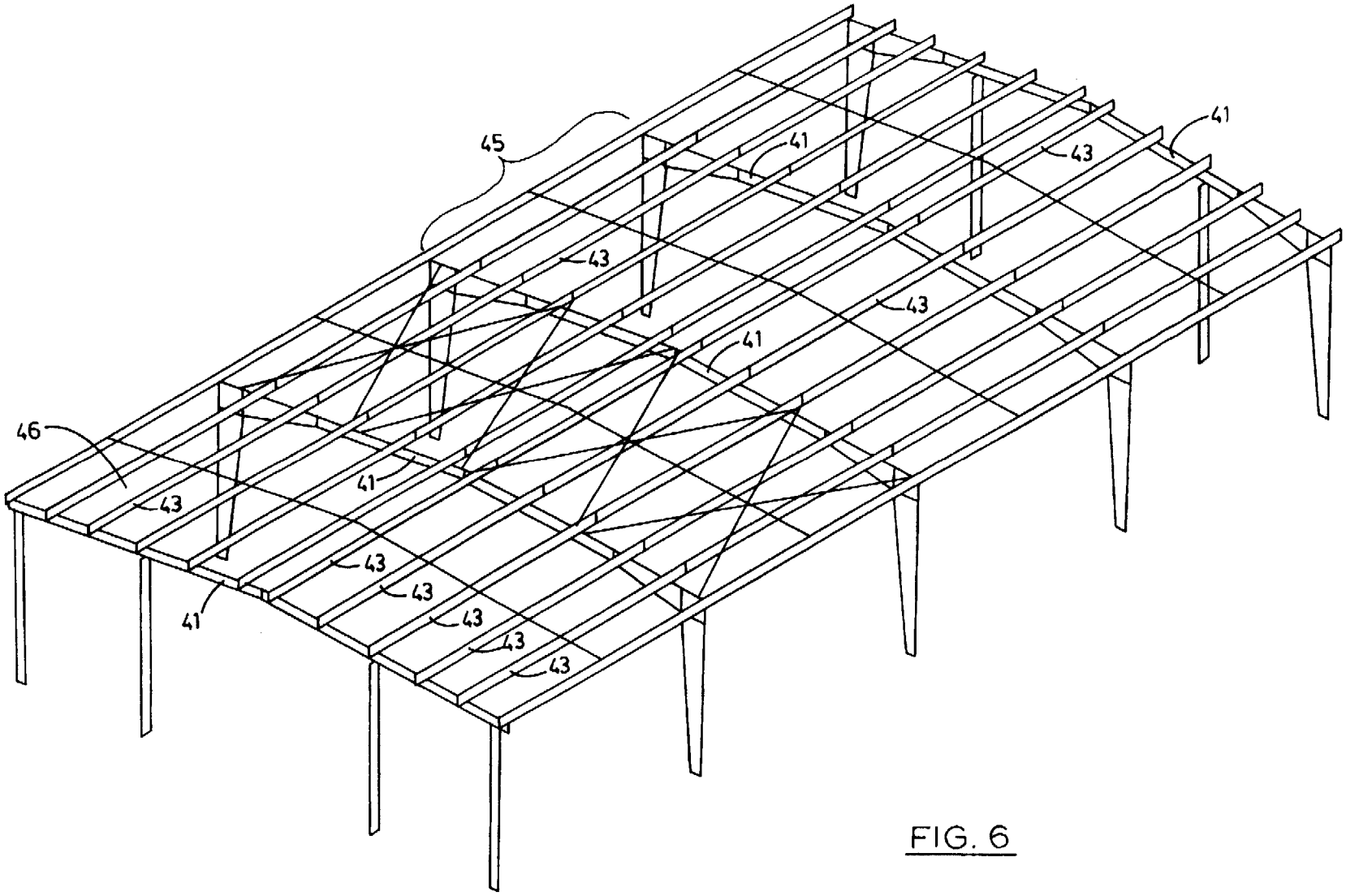
FIG. 6 is a perspective view of the frame of a metal building showing the beams, secondary roof members (purlins) and bays.

In use, the walls and cross members of a metal building has been constructed, but no roof has yet been placed on the building (see FIG. 6). A series of beams or rafters 41 are present at the roof level which define one or more bays 45 between them. Perpendicular to and in much more frequency than the beams or rafters are a set of secondary roof members or purlins 43.

Before the roof itself is installed, netting must be hung to cover some or all of the bays. The roof area must be measured and an appropriate quantity of netting ordered sufficient to cover the bays. It is preferable, if possible, that the netting pieces be of the same dimensions as the bays. This allows connection of the different pieces to be accomplished along a rafter or beam, instead of mid-span in the open area 46 of a bay.

The lightweight sled 11 is hoisted to the roof level using rope 29. It is then straddled across the secondary roof members 31. A bundled roll of netting 36 is then brought to the roof level and placed on the sled. The leading edge of the netting 36 is passed through distribution box 23 and spread out 37 over the roof members. The edges of the netting 37 which extend to the walls of the building are clipped thereto. The opposite edges should preferably reach a beam or rafter. The full roll of netting is unrolled and stretched across the bay between the beam/rafter and the wall. When completely unrolled, a next roll of netting is brought up to the sled and stretched across the adjacent bay. The edge of subsequent roll is attached to the loose edge of the prior roll by nylon lashings at appropriate intervals depending upon the mesh of the netting, but usually about every six inches (6"). This process is repeated until the last bay is covered using the last roll of netting. The result is one large continuous net made of up several smaller nets that have been lashed together.

It may occur that the netting dimensions do not exactly fit the dimensions of the bay. Under such circumstances, subsequent rolls of netting may be lashed to earlier netting at locations that are over secondary roof members or mid-span; however, these situations should be avoided, if possible. To further strengthen the support for the netting, each roll may be clipped not only to the side wall of the building but also to the opposite rafters as it is unrolled. If this technique is employed, it is not necessary to lash the many pieces of netting together, since each piece will be separately supported at its perimeter. This results in several nets (e.g. one per bay) as opposed to one large net composed of smaller nets that have been lashed together.

Depending upon the stage of construction of the building, a net may have been measured to cover an entire bay, but work at some location on that bay is not yet complete. The sled of the present invention may be used to unroll and attach the roll of netting over the completed area of the bay and brought up to the location where work is still in progress. By opening door 25, the remainder of the roll 36 of netting may be removed and placed on boards straddling the roof members, awaiting completion of construction. The sled 11 may then be used to dispense other netting in other locations of the building. When construction at the affected area is complete, the partially used roll 36 may again be loaded into the sled, and dispensed over the remaining portion of the bay.

DESCRIPTION OF THE PREFERRED EMBODIMENTS

In the preferred embodiment, the length of the sled rails 13 of the present invention should be at least eleven feet (11'). This is because the usual maximum distance between secondary roof members 31 is five feet (5'), and an eleven foot sled will always be supported by at least two such members. The rails and support members of the present invention may be made of wood, lightweight metal or plastic, depending upon the size and weight of the netting to be distributed. Top panel 25 on box 23 may be hinged at one side in order to allow the netting 36 to be removed from the sled before it has all been distributed. This allows a single sled to be disengaged from a given roll of netting in order to be moved around, thereby allowing for complete or partial installation of different rolls of netting at different locations on the same building. The distance between the lashings between adjoining netting pieces depends upon the mesh of the netting itself, but should be in the range of about every six inches (6").

In an alternative embodiment, the distribution box may be cone shaped having a hinged opening at the top for removing partially deployed netting.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. An apparatus for dispensing roof netting for installation over secondary roof members of a building comprising a sled having a pair of parallel rails separated by front and rear support members, a rope attached to said front support member, a platform mounted near a center of said sled, and an open-ended distribution cone having a closable upper door thereon for receiving or removing roof netting.

2. The apparatus described in claim 1 in which the parallel rails each have upwardly pointed tips at one end.

3. The apparatus described in claim 1 in which the parallel rails each have a length of approximately eleven feet.

4. A method of installing roof netting over secondary roof members of a building during construction comprising the steps of:

a. deploying across two or more of said secondary roof members a sled having a pair of parallel rails separated by front and rear support members, a rope attached to said front support member, a platform mounted near a center of said sled, and an open-ended distribution cone having a closable upper door thereon for receiving or removing roof netting;

b. loading at least one roll of roof netting onto the platform of the sled;

d. slowly pulling the sled in a direction that is parallel to beams of the building but perpendicular to the secondary roof members thereof using said rope;

e. passing the roof netting through the distribution cone on said sled as said sled is pulled forward;

f. spreading the netting out across said secondary roof members; and g. attaching edges of said netting which reach sides of the building to the building.

5. The method described in claim 4, further comprising:

h. attaching any remaining edges of the netting to subsequent rolls of netting deployed out across remaining secondary roof members.

* * * * *